US005287783A

United States Patent [19]

Mori

[11] Patent Number: 5,287,783

[45] Date of Patent: Feb. 22, 1994

[54] PAPER CUTTER

[75] Inventor: Chuzo Mori, Tokyo, Japan

[73] Assignee: Carl Manufacturing Co., Ltd., Tokyo, Japan

[21] Appl. No.: 991,559

[22] Filed: Dec. 16, 1992

[30] Foreign Application Priority Data

Mar. 2, 1992 [JP] Japan ..... 4-080462

[51] Int. Cl.[5] ..... B26D 1/18; B26D 7/02

[52] U.S. Cl. ..... 83/455; 83/485; 83/614

[58] Field of Search ..... 83/375, 383, 385-389, 83/452, 453, 455, 456, 485, 614

[56] References Cited

U.S. PATENT DOCUMENTS 2,790,498 4/1957 Carscallen ..... 83/383
3,077,805 2/1963 Stanley ..... 83/389
3,237,497 3/1966 Cook ..... 83/455 X
3,301,117 1/1967 Spaulding ..... 83/455
5,069,097 12/1991 Mori ..... 83/56

FOREIGN PATENT DOCUMENTS 1-132394 9/1989 Japan .

*Primary Examiner*—Eugenia Jones
*Attorney, Agent, or Firm*—Oliff & Berridge

[57] ABSTRACT

A paper cutter for cutting a pile of paper on a bed with a cutting blade carried on a slider while holding the paper pile with a paper holding plate and moving the slider along a rail supported in parallel with the bed. The paper holding plate is made to move separately from the rail and is moved vertically with respect to the bed. Thus, the paper pile placed on the bed is held vertically in relation to the bed by the paper holding plate so that it is cut without any slippage. This slippage is also prevented even after the cutting operation.

2 Claims, 6 Drawing Sheets

PAPER CUTTER

BACKGROUND OF THE INVENTION

1. Field of the Invention

The present invention relates to a paper cutter for accurately cutting a pile of paper on a bed by holding it without any slippage.

2. Description of the Prior Art

In a paper cutter of the prior art, as shown in FIG. 10, a rail 3 is supported at its one end on a bed 1 by a support 2, and a paper holding plate 4 is integrally mounted to move toward and away from the rail 3. For cutting the paper using this cutter, the rail 3 is raised at its free end on its base, and sheets of paper are placed on the bed. Then, the rail 3 is depressed on its base to hold the paper on the bed 1 by means of the paper holding plate 4. A lock mechanism 6 mounted on the end portion of the rail 3 is then retained by a retaining member 7 which is fixed on the bed 1, so that the holding of the paper by the paper holding plate 4 may be maintained. Next, a slider 5 (as shown in Japanese Utility Model Application No. 26776/1988) carried on the rail 3 is slid to cut the paper by action of a rotary blade mounted in the slider 5. Moreover, the paper cutting position is determined with reference to the edge of the paper holding plate 4, and the rotary blade cuts the paper while rotating with its side contacting the edge of the paper holding plate 4.

The paper cutter of the prior art described above has its rail and paper holding plate integrated and has the following problems. These problems are not serious in a case where the number of sheets of paper piled on the bed is small. In the case where this number is large, however, the large pile of paper is held by the paper holding plate at first from its side at the base end of the rail, because the paper holding plate is turned along an arcuate line together with the rail when the rail is depressed on its one end. As a result, the paper pile will slip due to the arcuate motion thereby leaving the end fulcrum of the rail consecutively apart from the upper sheets.

If the pile of paper is cut with a slippage, the cut sheets of paper will become uneven and thus, they cannot be cut to an accurate size. If the sheets of paper are merely piled on the bed when their cutting position is to be determined, the paper holding plate has its leading (or free) end raised together with the rail on the base end of the rail, which makes it difficult to determine the cutting position with respect to the edge of the paper holding plate. For this positioning, moreover, the cutting position has to be once confirmed before the cutting operation by depressing the rail. This cutting position will allow the piled sheets of paper to slip. Thus, there arises another problem that the cut sheets of paper will become uneven and will fail to have an accurate size.

SUMMARY OF THE INVENTION

Therefore, the invention provides a paper cutter which can hold a pile of paper without any slippage by means of a paper holding plate, even if the pile is composed of a number of sheets, and can facilitate determination of the cutting position.

In order to solve the above-specified problems, according to the invention, there is provided a paper cutter for cutting a pile of paper on a bed with a cutting blade carried on a slider while holding the pile of paper with a paper holding plate and moving said slider along a rail supported in parallel with said bed, wherein the improvement resides in that said paper holding plate and said rail are made to move separately, comprising: means for elastically moving said paper holding plate vertically upward; and means for moving said rail elastically in contact with the upper side of said paper holding plate and vertically movably in parallel with said bed.

With the construction described, above, the invention has the following advantages. Specifically, the paper holding plate is made to move separately from the rail and can be moved vertically with respect to the bed so that the paper sheets on the bed can be vertically held without any slippage with respect to the bed by the paper holding plate. At the same time, this paper holding plate can be arranged in parallel with the bed so that the cutting position can be easily determined with respect to the edge of the paper holding plate. Moreover, the rail is disposed vertically movably above the paper holding plate so that the paper holding plate, independent of the rail, can be depressed. By this depression, the paper holding plate is moved vertically relative to the bed and independently of the movement of the rail.

DESCRIPTION OF THE PREFERRED EMBODIMENT

Figure 1:
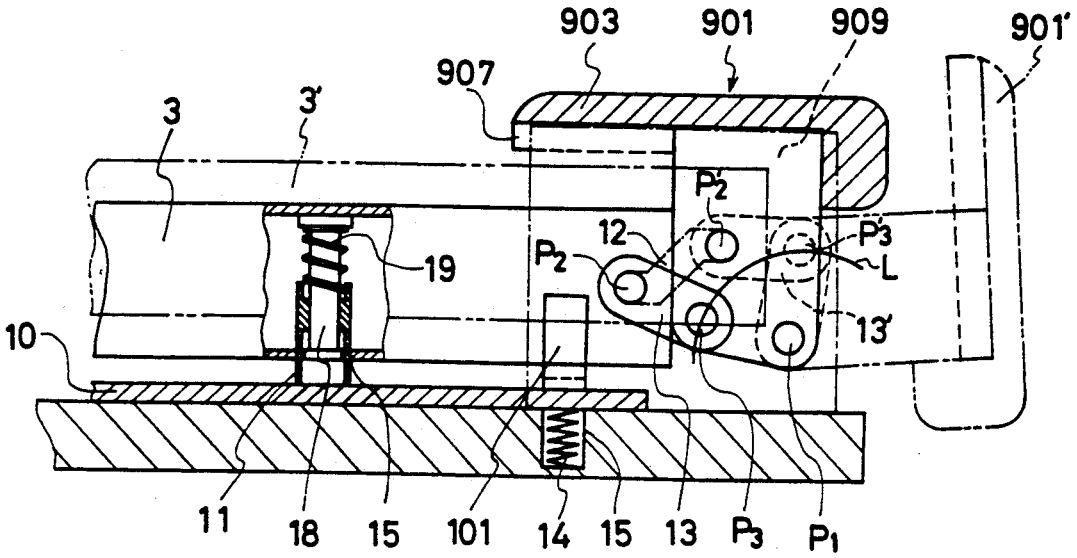
FIG. 1 is a longitudinal section showing an essential portion of one embodiment of the present invention.

The invention will now be described in connection with one embodiment thereof with reference to the accompanying drawings. The present embodiment will be schematically described at first with reference to FIG. 9. A rail 3 has its two ends supported by support members 8 and 9 fixed on a bed 1 such that it can move up and down. Below the rail 3, there is positioned a paper holding plate 10 that can be moved independently of the rail 3 and vertically with respect to the bed 1. The rail 3 per se carries a slider 5.

Figure 8:
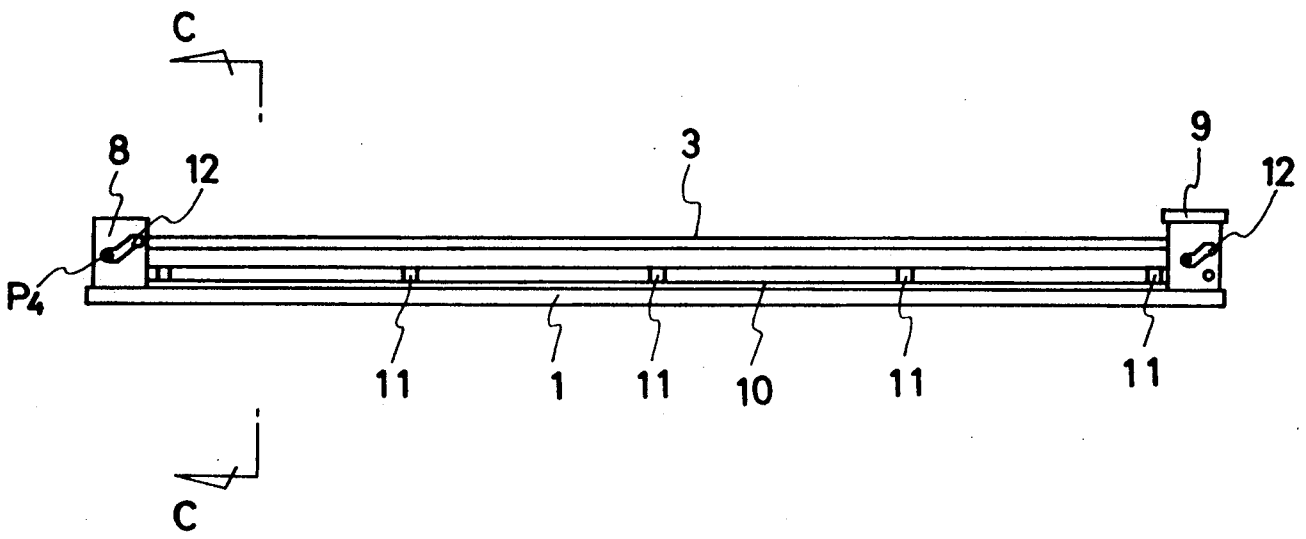
FIG. 8 is a front elevation of FIG. 9 and omits a slider.
Figure 9:
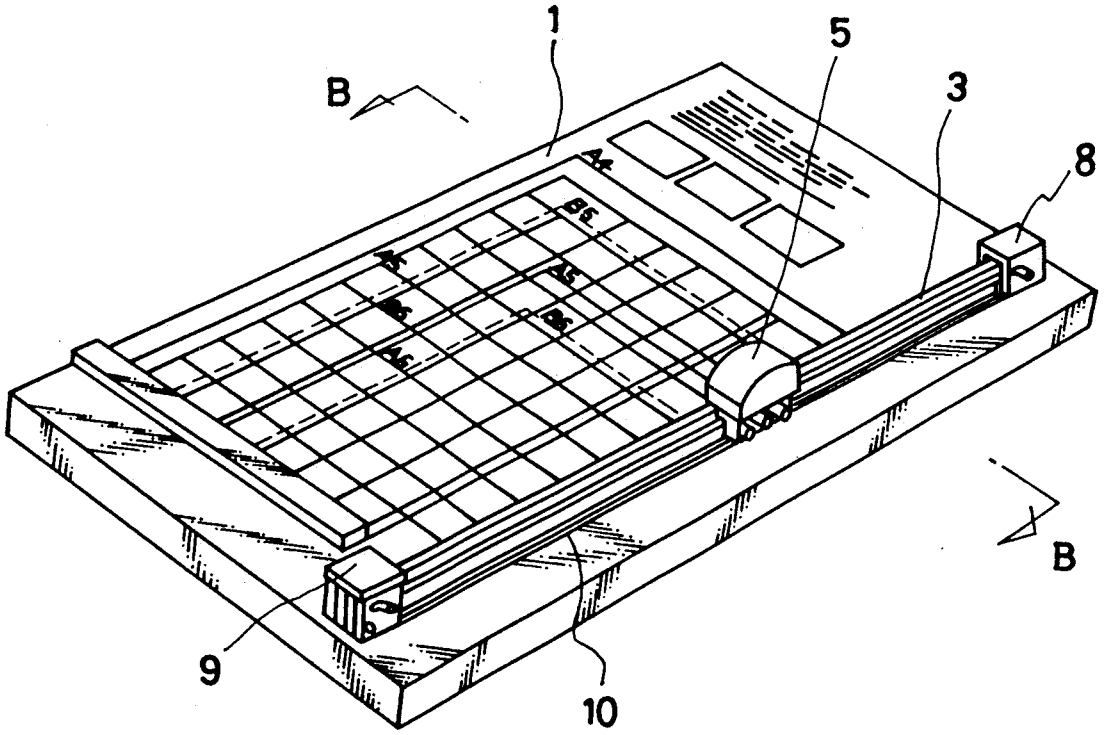
FIG. 9 is a perspective view showing the embodiment of the present invention.
Figure 10:
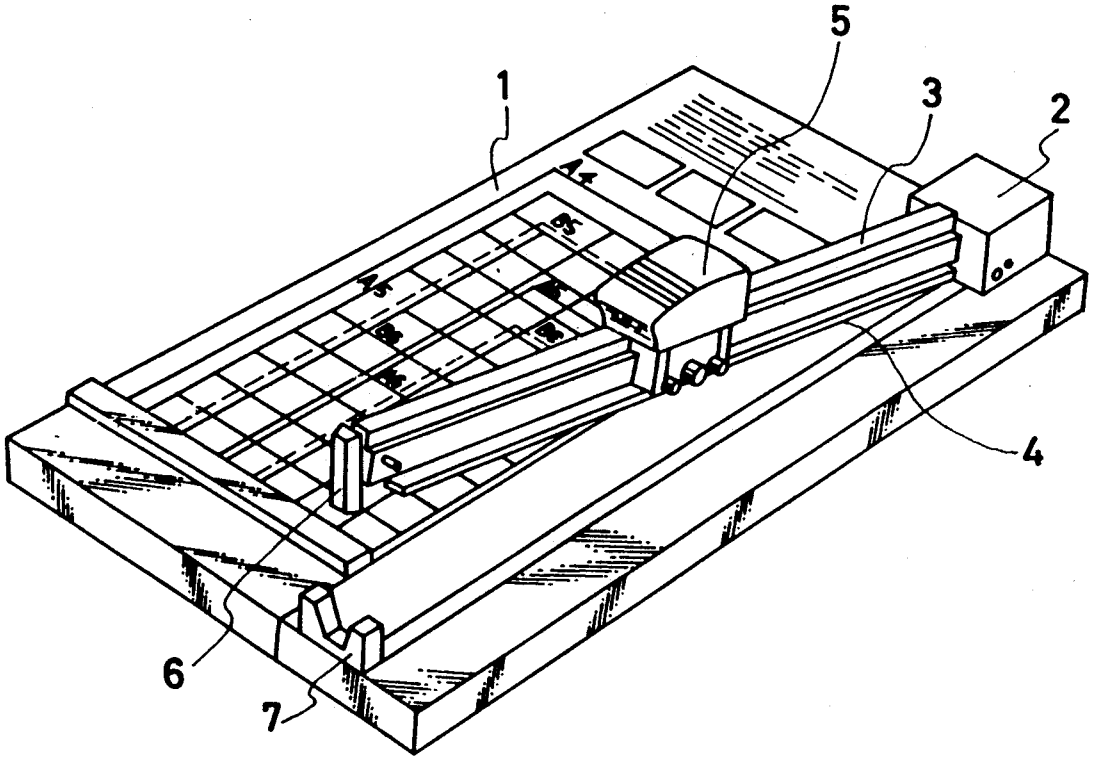
FIG.10 PRIOR ART
FIG. 10 is a perspective view showing an example of the prior art.

FIG. 8 is a side elevation of FIG. 9 while omitting the slider 5. The rail 3 can be moved up and down along guide slits 12 which are formed in the support members 8 and 9 supporting the two ends of the rail 3. The paper holding plate 10 is disposed independently of the rail 3 and is urged vertically toward the bed 1 in accordance with the movement of the rail by elastically extendible pins 11 which are disposed in the rail 3.

Figure 3:
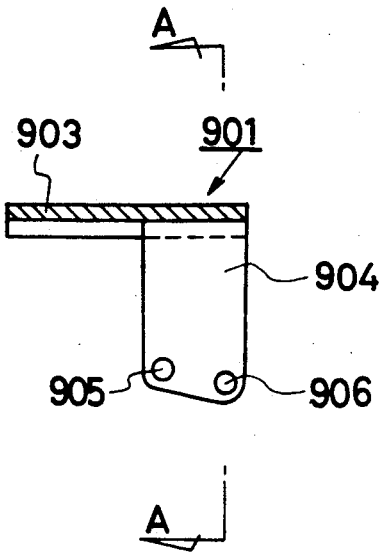
FIG. 3 is a longitudinal section showing a movable member of FIG. 1.
Figure 4:
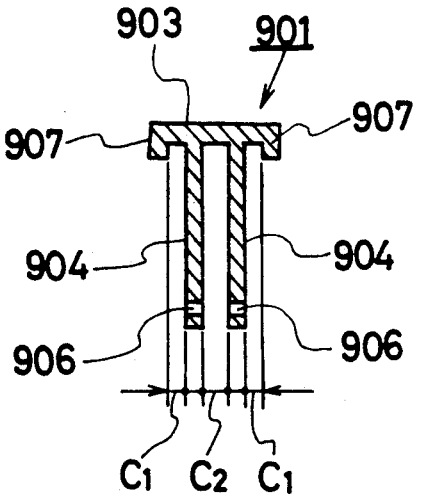
FIG. 4 is a longitudinal section taken along line A—A of FIG. 3.
Figure 7:
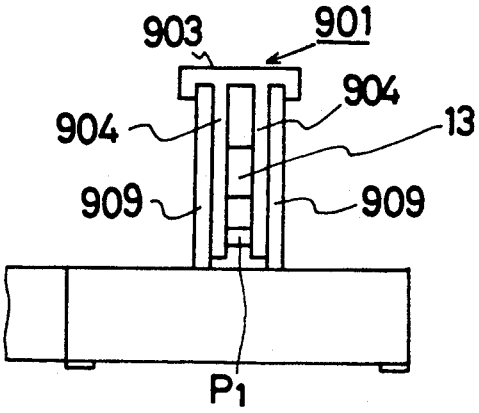
FIG. 7 is a righthand side elevation of FIG. 8.

With reference to FIG. 7, the support member 9 will be described in more detail. This support member 9 is composed mainly of a movable member 901 and a stationary member 902 (see FIG. 2). The movable member 901 is formed integrally with tongues 904 generally at a right angle with respect to a cover plate 903, as shown in FIG. 3, and each tongue 904 is bored with pin holes 905 and 906. These two tongues 904 are arranged in parallel with each other, as shown in FIG. 4. On the other hand, the cover plate 903 is formed with side portions 907 for improving the appearance thereof. The tongues 904 are so integrated with the cover plate 903 that a gap C1 is established between the side portions 907 and the tongues 904 while leaving a gap C2 between the tongues 904.

Figure 2:
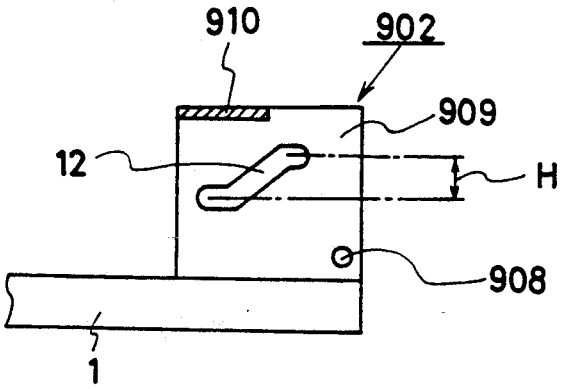
FIG. 2 is a longitudinal section showing a stationary member of FIG. 1.

On the other hand, the stationary member 902 is fixed on the bed 1 in such a gate shape that two side plates 909 are integrated by a top plate 910, as shown in FIG. 2. Each side plate 909 is formed with the guide slit 12 which is shaped by connecting horizontal holes having a height difference H through an oblique hole. The side plate 909 is also bored with a pin hole 908 so that a pin may be inserted into the pin hole 908 through the pin holes 906 formed in the tongues 904 of the movable member 901. Moreover, the side plates 909 of the stationary member 902 are fitted in the gaps C1 (as shown in FIG. 4) of the movable member 901, as shown in FIG. 7. Thus, the movable member 901 is assembled with the stationary member 902 by inserting the pin P1 into the pin holes 906 formed in the tongues 904 and the pin holes 908 formed in the side plates 909 of the stationary member 902, so that the movable member 901 can turn on that pin P1 with respect to the stationary member 902.

In FIG. 1, the rail 3 and the movable member 901 are connected through a link 13 by means of pins P2 and P3. And, this link 13 is fitted, as shown in FIG. 7, in the gap C2 (as shown in FIG. 4) between the tongues 904 of the movable member 901, as shown in FIG. 7.

Figure 6:
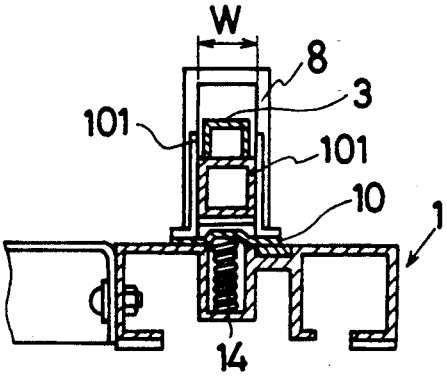
FIG. 6 is a longitudinal section taken along line C—C of FIG. 8.

The paper holding plate 10 is disposed, as shown in FIGS. 1 and 6, between and separately from the rail 3 and the bed 1. And, the paper holding plate 10 has its transverse position determined by guide members 101 which are fixed above the two end portions of the paper holding plate 10 and given a U-shaped section. In other words, the rail 3 is embraced by the two side parallel portions of the guide members 101. On the other hand, a compression spring 14 urges upward the paper holding plate 10 into abutment against the elastically extendible pin 11 which is installed inside the rail and comprises an angular tube with a pin 18 inserted so as to project elastically through an opening 15 of the rail 3 by a spring 19.

The pin 11 itself is made of resin so as to slide easily on the rail when it is pushed thereon. In this case, the elastic force of the pin 11 is sufficiently stronger than that of the spring 14 so as to hold a sheet or sheets of paper to be cut. Incidentally, the paper holding plate 10 has its two longitudinal edges contacting with the inner walls of the support members 8 and 9 so that its motion is limited.

Like the aforementioned structure of the stationary member 902 of the support member 9, moreover, the support member 8 shown in FIG. 8 is also formed into a gate shape having a width W, into which the rail 3 can be inserted, as shown in FIG. 6. The support member 8 also has its die plates bored with the guide slits 12 of the stationary member 902. In these guide slits 12, there are inserted a pin P4 which is supported by the other end of the rail 3, thus guiding the other end of the rail 3.

Figure 5:
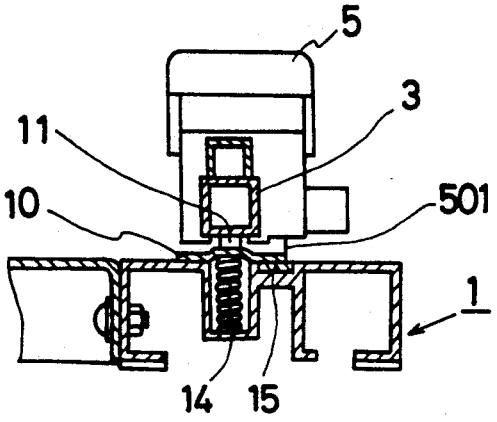
FIG. 5 is a longitudinal section taken along line B—B of FIG. 9 and showing an essential portion.

As shown in FIG. 5, the slider 5 is so fitted on the rail 3 that it can slide therealong to allow the side of a rotary blade 501 to contact with the edge of the paper holding plate 10. On the other hand, the bed 1 is equipped at its portion to receive the edge of the rotary blade 501 with a rubber member 15 for protecting the edge of the rotary blade 501.

The operation of the present embodiment thus constructed, will now be described in the following. If the movable member 901 is turned on the pin P1, as indicated at 901' in FIGS. 1 and 8, the pin P3 is moved along an arcuate locus L around the pin P1 so that the pin P2 at the leading end of the rail 3 is moved in the guide slits 12 through the link 13. In accordance with this movement, the pin P4 is also moved. Since the rail 3 has its two ends guided in the guide slits 12 of the support members 8 and 9 by the pins P2 and P4, it is lifted in a horizontal position by the height difference H between the two ends of the guide slits 12.

When the rail 3 is thus lifted, the paper holding plate 10 is also lifted, while being guided by the guide members 101 along the rail 3, vertically to a position 3' with respect to the bed 1 by the action of the compression spring 14, so that the bed 1 has its upper surface arranged in parallel with the paper holding plate 10 to establish a gap. If the extension size, as determined by the elasticity of the pins 11, is designated at h, there holds a relation of $H=h+\alpha$ ($\alpha$=gap) between itself and the height difference H.

Since the gap is thus formed between the paper holding plate 10 and the bed 1, the cutting position of paper and the edge of the paper holding plate 10 can be easily aligned by inserting the paper into that gap. After this alignment of the paper cutting position, the movable member 901 is turned on the pin P1 to its original position. Then, the rail 3 has its two ends descended by the height difference H along the guide slits 12 by the actions of the pins P2 and P4 which are moved in the guide slits 12 by the link 13. When the pins P2 and P4 come into the lower horizontal portions of the guide slits 12, they are held therein by the elastic forces of the pins 11.

During the ascent (or descent), the rail 3 is horizontally moved between position 3' and position 3. Since the rail 3 and the paper holding plate 10 are separated, the rail 3 is obliquely moved from the position 3' to the position 3 while causing the leading ends of the holding pins 11 anchored at the rail 3 to slide on the upper surface of the paper holding plate 10 thereby pushing against the paper holding plate 10. Since this paper holding plate 10 has its horizontal movement limited by the stationary member 902 and the support member 8, it is moved downward toward the bed 1 so that the pile of paper on the bed 1 is pushed and held in its position.

In FIG. 1, the center of the pin P3 of the movable member 901 at its vertical position is located just under the straight line connecting the centers of pins P1 and P2, thereby an unexpected relocation of the lock status of the pin P2 in the horizontal hole can be avoided because the pin P1 wants to move downward in vain when the rail is pushed by chance in the right direction in FIG. 8.

As has been described in detail hereinbefore, according to the invention, the paper holding plate is made separate and independent of the rail and is vertically moved with respect to the bed. As a result, the pile of paper on the bed can be vertically held with respect to the bed by the paper holding plate so that it is not broken. Since the paper holding plate can be arranged in parallel with the bed, the cutting position can be easily determined with respect to the edge of the paper holding plate. Moreover, since the rail is disposed vertically movably over the paper holding plate, the paper holding plate can be pushed independently of the rail. As a result, the pile of paper can be accurately cut while being pushed and held by the paper holding plate which is vertically moved with respect to the bed independently of the movement of the rail by the pushing force of the rail.

What is claimed is:

1. A paper cutter for cutting a pile of paper on a bed using a cutting blade carried on a slider while the pile of paper is held by a paper holding plate and moving said slider along a rail supported such that said rail is always parallel to said bed, wherein said paper holding plate and said rail are assembled to move separately, movement of said rail being guided by two identically configured oblique guide slits with horizontal portions disposed at upper and lower ends of each guide slit respectively, said guide slits being provided in two stationary support members located at opposing ends of said bed, comprising:

a movable member pivoted on one of said stationary support members to move said rail back and forth in said guide slits between said upper and lower horizontal portions through a link, said link allowing said rail to move only obliquely up and down a predetermined distance, while ensuring said rail remains parallel to said bed;

a first spring means to push said paper holding plate against said rail; and a second spring means provided on a bottom side of said rail to push against paper holding plate, such that a pushing force exerted by said second spring means is relatively stronger than a pushing force exerted by said first spring means.

2. A paper cutter according to claim 1, wherein a center axis of a first pin, anchored to one end of a bottom edge of said support member and projecting through a first hole in said link, is located below a straight line connecting center axes of second and third pins when said movable member is in a vertical position, said second pin pivoting through said support member and said movable member at a pinhole located opposite to said second pin and said third pin being anchored to said rail and projecting through both a second hole in said link and said guide slits.

* * * * *